US010349704B2

(12) United States Patent
Sharp

(10) Patent No.: US 10,349,704 B2
(45) Date of Patent: Jul. 16, 2019

(54) RECLOSABLE PIN FOR SECURING A TRAIN OF A DRESS

(71) Applicant: BELLS BRIDAL LTD, Grangemouth, Stirlingshire (GB)

(72) Inventor: Isabel Sharp, Grangemouth (GB)

( * ) Notice: Subject to any disclaimer, the term of this patent is extended or adjusted under 35 U.S.C. 154(b) by 0 days.

(21) Appl. No.: 15/545,644

(22) PCT Filed: Jan. 18, 2016

(86) PCT No.: PCT/GB2016/050097
§ 371 (c)(1),
(2) Date: Jul. 21, 2017

(87) PCT Pub. No.: WO2016/116736
PCT Pub. Date: Jul. 28, 2016

(65) Prior Publication Data

US 2018/0014610 A1 Jan. 18, 2018

(30) Foreign Application Priority Data

Jan. 21, 2015 (GB) ..... 1501032.5

(51) Int. Cl.

| | |
|---|---|
| ***A44B 9/12*** | (2006.01) |
| ***A44C 1/00*** | (2006.01) |
| ***A44B 9/14*** | (2006.01) |
| *A41H 5/01* | (2006.01) |
| *A44B 99/00* | (2010.01) |

(52) U.S. Cl.
CPC ..... *A44B 9/12* (2013.01); *A44B 9/14* (2013.01); *A44C 1/00* (2013.01); *A41H 5/01* (2013.01); *A44B 99/00* (2013.01)

(58) Field of Classification Search
CPC .. A41H 5/01; A44B 99/00; A44B 9/12; A44B 9/14; A44C 1/00
See application file for complete search history.

(56) References Cited

U.S. PATENT DOCUMENTS

| | | | | | |
|---|---|---|---|---|---|
| 559,169 | A | | 4/1896 | Farmer | |
| 1,383,054 | A | * | 6/1921 | Anderson | A44B 9/14 24/710.1 |
| 1,458,029 | A | | 6/1923 | Cargill | |
| 1,466,226 | A | | 6/1923 | Hoffmaster | |
| 1,589,228 | A | * | 6/1926 | Robb | A41F 15/02 132/278 |
| 1,597,056 | A | * | 8/1926 | Cloud | A41F 15/02 24/336 |
| 1,619,242 | A | * | 3/1927 | Denman | A41F 15/02 24/353 |
| 1,949,974 | A | * | 3/1934 | Nixon | A44B 9/12 24/363 |
| 2,026,930 | A | * | 1/1936 | Mabel | A44B 9/14 24/706.1 |
| 2,491,301 | A | * | 12/1949 | Dodds | A44B 9/14 24/708.8 |

(Continued)

*Primary Examiner* — Robert Sandy
*Assistant Examiner* — David M Upchurch

(57) ABSTRACT

Apparatuses and methods for securing the train of a dress, for example a bridal dress, in a raised position are disclosed herein. A reclosable pin (10) having a curved point portion (20) passing through the bodice of a dress is also disclosed. The pin, when in the closed position, forms a closed loop having a tapered shape such that the closed loop is narrowest adjacent to the base portion (12).

5 Claims, 6 Drawing Sheets

(56) References Cited

U.S. PATENT DOCUMENTS

| | | | | | |
|---|---|---|---|---|---|
| 2,646,668 | A | * | 7/1953 | Rinehart | A44C 1/00 2/153 |
| 2,775,013 | A | * | 12/1956 | Pedrero | A44B 99/00 24/518 |
| 2,780,852 | A | * | 2/1957 | Shelton | A44B 9/12 24/710.2 |
| 2,792,607 | A | * | 5/1957 | Packham | A44C 1/00 24/350 |
| 2,904,865 | A | * | 9/1959 | Ziegenbein | A44B 9/12 24/710 |
| 3,181,214 | A | * | 5/1965 | Ambrosio | A44B 9/12 24/364 |
| 3,465,392 | A | * | 9/1969 | Francis, Jr. | A44B 9/12 24/709.1 |
| 3,735,453 | A | * | 5/1973 | Nathans | A44B 9/14 24/704.2 |
| 6,324,734 | B1 | * | 12/2001 | Joseph | A44B 9/12 24/709 |

* cited by examiner

RECLOSABLE PIN FOR SECURING A TRAIN OF A DRESS

FIELD OF INVENTION

The invention relates to dresses having trains, for example bridal dresses, where it is required to convert the dress from a first form in which the train trails along the ground behind the dress, for example during a wedding ceremony, to a second form in which the train is raised and supported at least partially clear of the ground, for example during dancing. In particular the invention relates to devices enabling the transformation of a dress from the first form to the second form.

BACKGROUND OF THE INVENTION

It is known to provide wedding dresses which have a removable train. The train can be attached to the dress during the ceremonial part of a wedding, and can be removed from the dress to allow the wearer to wear the dress without a train at other times, for example during a dance or informal reception. However this requires special dresses which are designed to have a separable train.

It is also known to pin a train up to the upper part of a dress in order to convert the dress from a first form in which the train trails along the ground behind the dress to a second form in which the train is raised and supported clear of the ground, or in which the train is raised so that it only trails lightly on the ground. However this can be time consuming, and requires expert knowledge on the part of the person doing the pinning.

It is also known to provide a dress having a train in which the train is provided with prefabricated attachment points, for example loops of tape material, which can be gathered together and attached by pins to predetermined attachment points on the dress. However this also requires special dresses which have the tapes pre-attached to the train.

None of the prior art methods of converting a dress from a dress with a train to a dress without a train allow an unskilled user to convert, quickly and simply, any dress having a train to a dress in which the train does not trail along the ground.

It is an object of the present invention to overcome one or more of the above problems.

SUMMARY OF THE INVENTION

According to a first aspect of the present invention there is provided a reclosable pin for securing a train of a dress in a lifted position comprising:

- a generally U-shaped resilient arcuate base portion,
- first and second leg portions extending from the base portion,
- a return arm at the upper end of the first leg extending substantially perpendicular to the first leg portion,
- a curved point portion at the upper end of the second leg portion,
- a point provided at the end of the curved point portion directed towards the first leg portion, and
- a clasp provided at the free end of the return arm for engagement with the second leg portion,
- wherein the clasp comprises a loop extending toward the base portion, the free end of the loop extending away from the first leg portion to provide an abutment surface for the second leg portion directed toward the first leg portion when the pin is in a closed position, and

- wherein the pin, when in the closed position, forms a closed loop having a tapered shape such that the closed loop is narrowest adjacent to the base portion.

In this specification the components of the pin are described with reference to an orientation of the pin in which the pin is oriented so that the base portion is at the lowest point. For example the term "upper end" is used to refer to the end of a leg portion which is furthest from the base portion.

Preferably the base portion and the first and second leg portions are formed from one piece of wire to form a general U-shape.

Preferably the first and second leg portions are and base portion are arranged such that the second leg portion, the base portion and the first leg portion may be sequentially threaded through an aperture formed by the point in the material of a dress. Preferably the second leg portion, the base portion and the first leg portion do not include a looped portion.

Preferably the leg portions diverge from the base portion, so that the U-shape has the appearance of a truncated V-shape with a rounded truncated base.

The shape of the pin allows the first leg to be held behind the fabric of a bodice of a dress, for example a zip tape, and the gathered folds of the train to sit in the arcuate base portion, and to be held securely by the pin.

Preferably the first and second leg portions are adapted to be urged from an open position of the pin, in which the pin forms an open loop, against the resilience of the resilient arcuate base portion to the closed position.

A user can this simply press the two legs towards each other to open or close the pin.

Preferably the return arm is provided with a mounting area for a decorative feature thereon.

The return arm preferably extends at about 90 degrees from the first leg portion, so that, when the pin is fixed to a dress and the first leg portion is substantially vertical, the return arm is substantially horizontal. Any decorative feature on the return arm, such as a jewel or brooch-like ornament, covers the gathered folds of the train, and forms a visually attractive feature.

Preferably the pin is made of stainless steel. Alternatively any metal which has the appropriate resilience may be used.

Preferably the base portion, the first and second leg portions and the return arm define a pin plane. Preferably the wire loop is s-shaped when viewed in a direction orthogonal to the pin plane.

This allows the curved point portion to be screened by the wire loop when the pin is in the closed position, to protect a user from injury.

Preferably the point of the curved point portion is inside the closed loop when the pin is in the closed position.

Preferably the abutment surface is located between the first leg portion and the second leg portion when the pin is in an open position.

Preferably the second leg portion is located between the abutment surface and the first leg portion in the closed position.

To move the pin from the open position to the closed position, the user pushes the second leg portion towards the first leg portion, so that the curved point portion moves past the closed wire loop, then urges the second leg portion sideways so that the curved point portion engages with the closed wire loop as the user reduces the force applied to the second leg portion.

According to a second aspect of the present invention there is provided a method of using a reclosable pin according to the first aspect to raise a train of a dress, the dress comprising a bodice and a train extending below the bodice, the method comprising the steps of:

inserting the point of the pin through a first aperture in the bodice of the dress;

guiding the pin downwards so that the pin exits through a second aperture in the bodice;

rotating the pin while threading the second leg portion and the base portion through said apertures until the arcuate base portion is at the lowermost position and the first and second leg portions extend upwards from the base portion;

inserting the point of the pin through a portion of the train of the dress such that the pin forms an aperture in the train of the dress; and engaging the curved point portion and the clasp such that the portion of the train of the dress is held inside the closed loop of the pin in a raised position.

According to a second aspect of the present invention there is provided a method of raising a train of a dress, the dress comprising a bodice and a train extending below the bodice, the method comprising the steps of:

providing a substantially planar pin having first and second leg portions tapering outwards from an arcuate base portion, a return arm and clasp provided at the upper end of the first leg portion and a point portion engageable with the clasp provided at the upper end of the second leg portion;

inserting the point portion of the pin through a first aperture in the bodice of the dress;

guiding the pin downwards so that the point portion exits through a second aperture in the bodice;

rotating the pin while threading the second leg portion and the base portion through said apertures until the arcuate base portion is at the lowermost position and the first and second leg portions extend upwards from the base portion;

inserting the point portion of the pin through a portion of the train of the dress such that the point portion forms an aperture in the train of the dress; and engaging the point portion and the clasp to close the pin such that the portion of the train of the dress is held in a raised position inside a closed loop of the pin formed by the first and second leg portions, the arcuate base portion, the return arm, the clasp and the point portion.

Preferably the method of the second or third aspects comprises the further steps of:

selecting a plurality of areas of the train to be raised;

at each selected area gathering a portion of the train of the dress and inserting a pin through the train of the dress to hold the gathered portion of the train of the dress in the pin;

engaging the curved point portion and the clasp such that the plurality of gathered portions of the train of the dress are held inside the closed loop of the pin in the raised position.

The areas may be selected to be a distance from a lower edge of the train which is approximately equal to a distance measured from a waist portion of the dress to a lower edge of the dress at the front of the dress.

If the pin is secured to the rear of the dress at a height equal to the height of the waist portion at the front of the dress, this ensures that when the gathered portions of the train of the dress are held inside the closed loop of the pin, then the train does not trail excessively on the ground.

In one embodiment three areas may be selected, including a first area at the centre of the train and two further areas located either side of the centre of the train and approximately equidistant from the first area.

This arrangement can ensure that the train is effectively raised in its entirety, while ensuring that the dress with the raised train maintains a visually attractive appearance.

BRIEF DESCRIPTION OF DRAWINGS

Embodiments of the invention are described, by way of example, with reference to the accompanying drawings in which.

DESCRIPTION OF SPECIFIC EMBODIMENTS

Figure 1:
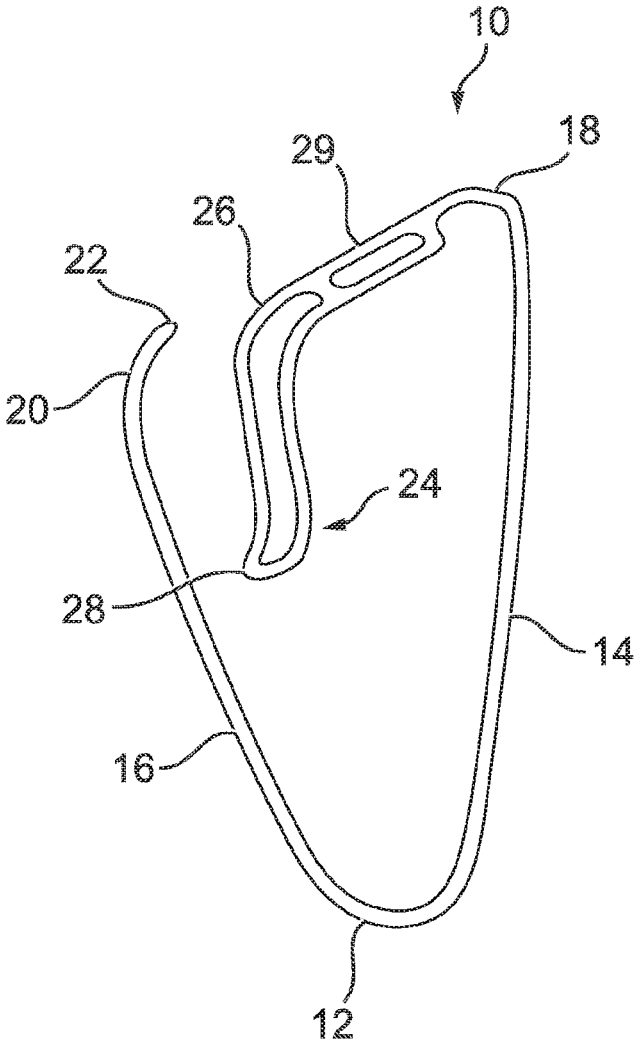
FIG. 1 is a perspective view of the dress pin according to an embodiment of the present invention in the open position.

With reference to FIG. 1 a reclosable pin 10 for lifting a train 40 of a dress 42 comprises a resilient arcuate base portion 12 and first 14 and second 16 leg portions that extend upwards from the resilient arcuate base portion 12 to form a general U-shape, with the leg portions 14, 16 diverging from a rounded base. Typically the base portion 12 has a radius of between 10 mm and 40 mm, to accommodate gathered material of a train as described below.

Located at the upper end of the second leg portion 16 is a curved point portion 20 that terminates with a point 22. The point 22 is curved towards the first leg portion 14.

Located substantially perpendicular to the first leg portion 14 is a return arm 18. At the end of a return arm 18 is a clasp 24 that further comprises a wire loop 26. In between the clasp 24 and first leg portion 14 along the return arm 18 an upper mounting portion 29 is provided, for mounting a decorative feature, for example a personalised message engraved on a plate, or a jewelry design or similar. The mounting portion is an area of the return arm having increased width, and therefore provides strength and rigidity to the return arm.

Figure 2:
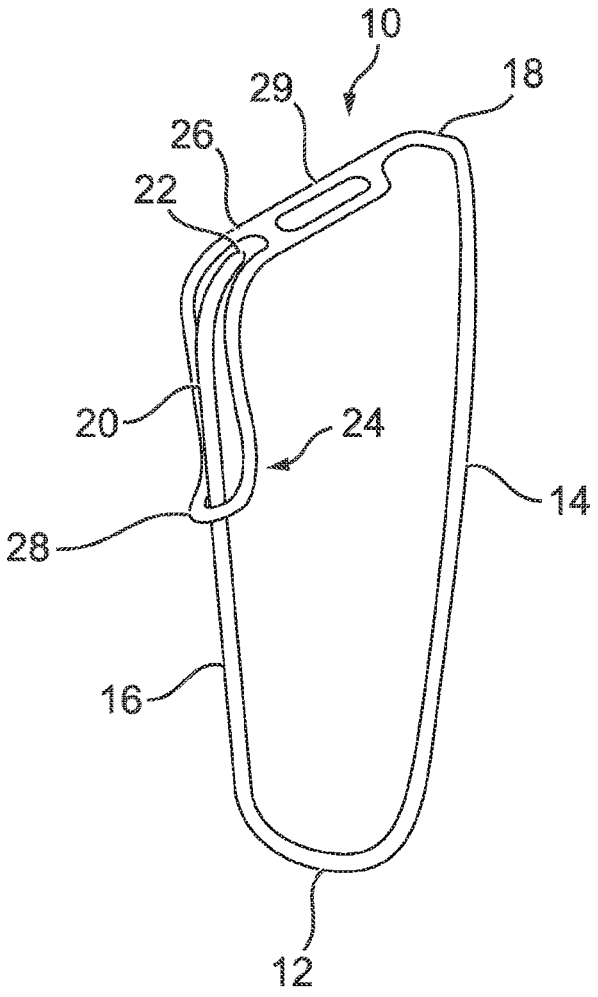
FIG. 2 is a perspective view of the dress pin of FIG. 1 in the closed position.

As illustrated in FIGS. 1 and 2, the reclosable pin 10 can move between an open and a closed position. In the open position as displayed in FIG. 1 the second leg portion 14 is disengaged from clasp 24 and there is a gap between the clasp 24 and the second leg portion 16.

To put the pin 10 in the closed position the second leg portion 16 is moved in a direction orthogonal to the clasp 24, then the second leg portion 16 is pushed forward toward the first leg portion 14 past the clasp 24, then the first leg portion 14 is aligned with the clasp 24, then the second leg portion 16 is released and the second leg portion 16 experiences a restoring force from the resilient arcuate portion 12, forcing the curved point portion 20 of the second leg portion 16 to engage with the closed wire loop 26 such that the curved point portion 20 is held inside the clasp 24 by an abutment surface 28.

As illustrated in FIG. 2, when the reclosable pin 10 is in the closed position the curved point portion 20 is held such that the point 22 is held inside the wire loop 26. This has the advantage of preventing injuries to a user or damage to a user's clothing, as no sharp point protrudes out of the wire loop 28.

The mounting portion 29 may be provided with a decorative feature thereon. Mounting a decorative feature 29 on top of the mounting portion has the advantage of obscuring the unsightly clasp 24 and adding to the style of the whole dress 42. The decorative feature may be a jewel, stone, piece of precious metal or any other ornamental article.

The reclosable pin 10 may be manufactured from any suitable metal or material. In an embodiment of the present invention the reclosable pin 10 is made from polished steel, for example stainless steel. If a more a visually pleasing and decorative reclosable pin 10 is required the pin 10 may be manufactured from alloys with a high precious metal content. Other suitable metals include German silver and nickel plated iron. Other decorative features may be attached to the reclosable pin 10 such as a key ring with an engraving attached or an ornamental chain.

The reclosable pin 10 must be manufactured such that it is able to support the weight of a large train 40 of a dress 42. However, the pin 10 must also be shaped finely enough to be able to be inserted into fabric.

The base portion 12, first 14 and second 16 leg portions and the return arm 18 define a pin plane. In an embodiment of the present invention when the wire loop 26 of the reclosable pin 10 is viewed in a direction orthogonal to the pin plane the shape of the wire loop portion 26 is s-shaped.

With reference to FIGS. 3 to 7, the process of how the reclosable pin 10 can be used to raise the train 40 of a dress 42 will now be described.

Figure 3:
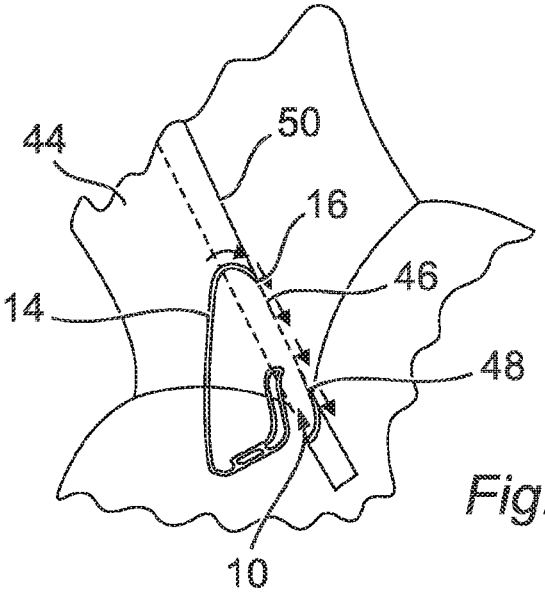
FIG. 3 is a partial view of the bodice of a dress showing a first stage in the use of the pin of FIG. 1, in which the point of the pin is inserted through a first aperture in the bodice of the dress guiding the pin downwards so that the pin exits through a second aperture in the bodice.

The first stage of the process is to insert the reclosable pin 10 into a discrete area of a bodice 44 of the dress 42, as shown in FIG. 3. The area in which the pin 10 is inserted into the bodice can be changed depending on the stylistic effect required. Typically the pin 10 is fixed to the bodice 44 at waist height. The pin 10 is inserted with the point 22 directed downwards into a reinforced section 50 of the dress 42, for example the fabric tape of a zip fastener or the reinforced seam of the bodice 44, located at the centre of the rear of the dress 42. The pin is inserted such that the point 22 of the pin 10 forms two apertures: a first aperture 46 as the point 22 enters the bodice 46 and a second aperture 48, below the first aperture 46, as it exits the bodice 44.

Figure 4:
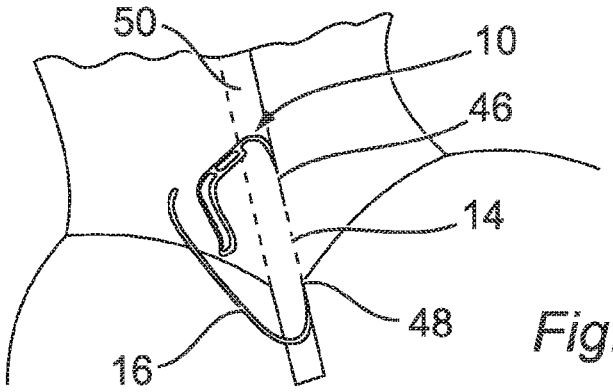
FIG. 4 is a partial view of the bodice of a dress showing a second stage in the use of the pin of FIG. 1, in which the pin has been rotated and the second leg portion and arcuate base portion have been threaded through both the first and second apertures.
Figure 5:
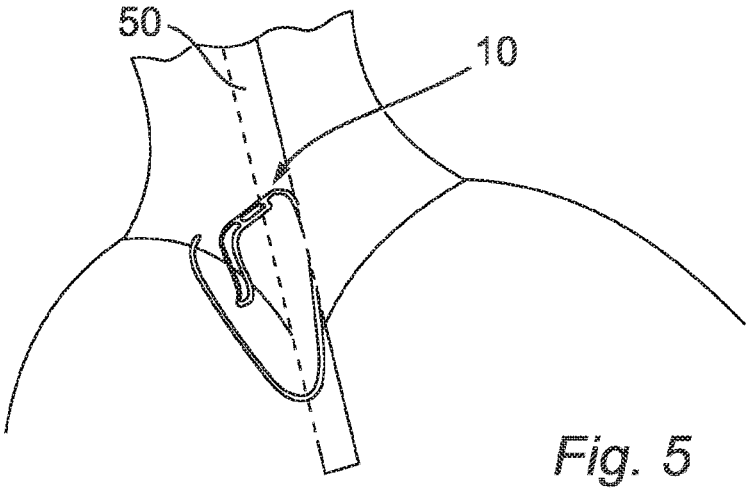
FIG. 5 is a partial view of the bodice of a dress showing a third stage in the use of the pin of FIG. 1, in which the pin has been lowered such that the arcuate base portion is at the lowermost position and the first and second leg portions extend upwards from the base portion, with the return arm preventing the pin from sliding further down the dress.

The second stage of the process is to thread the first leg portion 16, the base portion 12 and the second leg portion 14 through the apertures 46, 48, while rotating the pin 10, until the first 14 and second 16 leg portions are in a generally upright position, as shown in FIG. 4. The pin 10 is then pushed downwards as far as it will go, to the position shown in FIG. 5. In this position, the pin 10 is supported by the return arm 18, which abuts the first aperture 46 in the reinforced section 50 of the dress 42. The pin is held in an upright position by the second leg portion 14 which is held in the first and second apertures 46, 48. In this position the pin 10 can support the weight of any dress fabric held within the loop of the pin 10.

Figure 6:
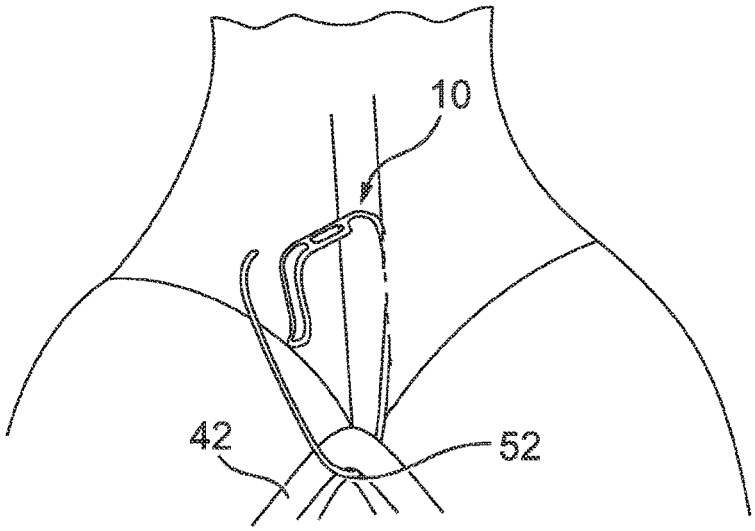
FIG. 6 is a partial view of the bodice of a dress showing a fourth stage in the use of the pin of FIG. 1, in which the second leg portion and the base portion are threaded through apertures formed in the gathered material of the train of the dress.
Figure 7:
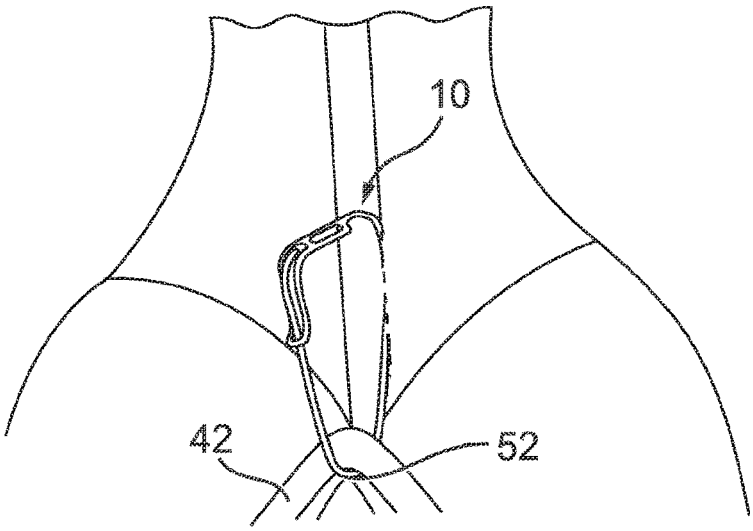
FIG. 7 is a partial view of the bodice of a dress showing a fifth stage in the use of the pin of FIG. 1, in which the curved point portion and the clasp engage such that the gathered material of the train of the dress is held inside the closed loop of the pin in a raised position.

In the third stage of the process, a portion of the train 40 can be gathered together and held within the loop of the pin, as shown in FIG. 6. When the pin 10 is in an open position, the second leg portion 16 extends upwards and outwards from the dress 42, making it easy to present a gathered portion of the train onto the point 22 of the pin 10. The point 22 of the pin 10 is inserted into the train 40 to form an aperture 52 in the train 42 of the dress 40, and gathered material is slid down the second leg portion 16 to rest in the base portion 12 between the first 14 and second 16 leg portions. The process of the third stage can then be repeated for other portions of the train 40 which are to be gathered and held in a raised position by the pin 10.

Once all the gathered portions of the train 40 are held in the base portion 12 between the first 14 and second 16 leg portions, the second leg portion 14 is engaged in the clasp 24, as described above, to close the pin 10. The train 40 is then held securely by the pin 10 in a raised position.

With reference to FIGS. 8 to 11, the process for selecting and raising multiple portions 54 of the train 40 of the dress 42 will now be described. In the described method three portions of the train 40 are lifted and held by the pin 10, although if required more or fewer portions may be lifted.

Figure 9:
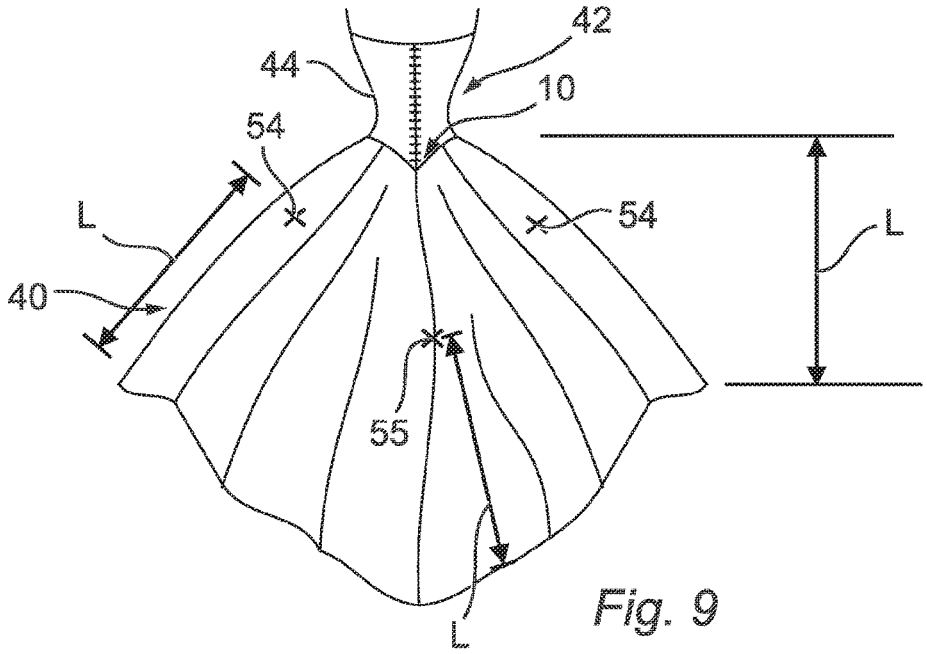
FIG. 9 shows a dress to which the pin of FIG. 1 is attached prior to raising the train.

The first stage of the process is to select three areas 54, 55 of the bridal train 40 at which portions of the train 40 that are to be lifted. The pin is fixed to the dress 42 at a height L above the ground. Typically the height L is equal to the height of the waist of the dress above the ground. Two lateral areas 54 are selected on the left and right sides respectively of the bridal train 40 and a further central area 55 is selected at the rear of the dress 42, as shown in FIG. 9. Typically the lateral areas 54 are equidistant from the central area 55. Each area 54, 55 is located a distance which is approximately equal to the distance L from the lower edge of the bridal train 40, so that when the area 54, 55 is lifted to the height of the pin 10, the lower edge of the bridal train is more or less at ground level. The areas can be marked with conventional dress pins.

Figure 8:
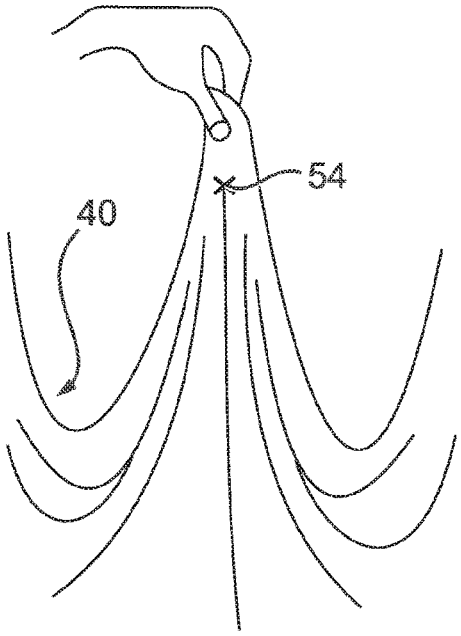
FIG. 8 is an illustration of how a user may hold the folds of the train of the dress in order to gather material of the train for placing on the point of the pin and threading onto the second leg portion of the pin.
Figure 10:
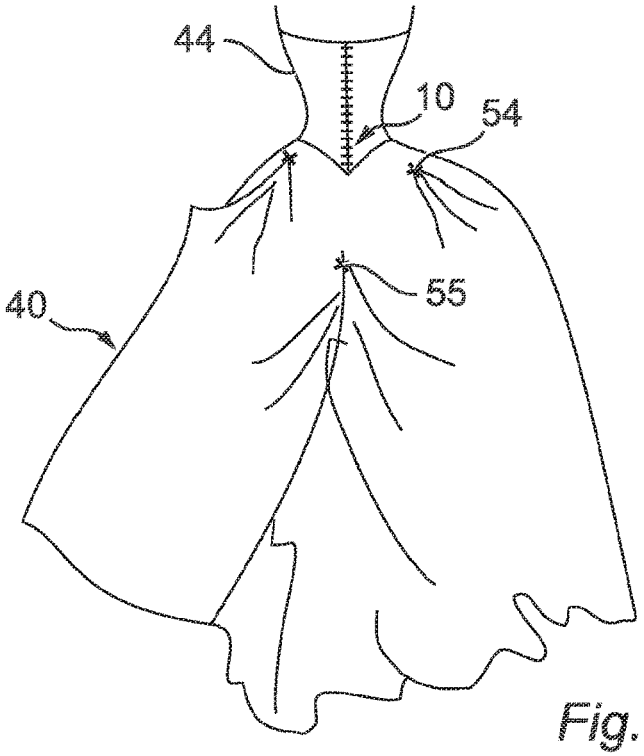
FIG. 10 shows the dress of FIG. 9 in which three areas for attachment to the pin have been identified.
Figure 11:
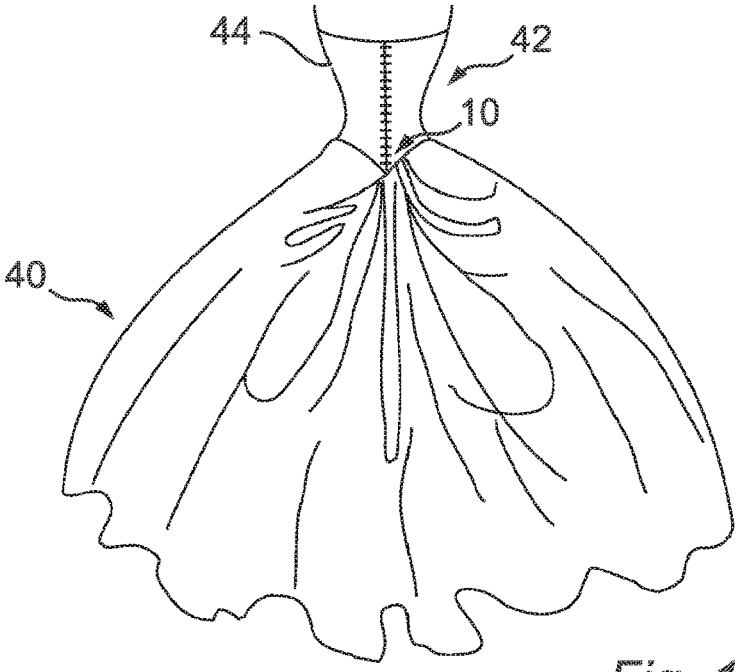
FIG. 11 shows the dress of FIG. 9 after the three areas of the train have been attached using the pin of FIG. 1 and the train has been raised.

The second stage of the process is to gather together material from the train 40 of the dress 42 at each area 54, 55, as shown in FIG. 8. If required a conventional dress pin can be used to hold together temporarily the gathered material. Material from the underlining and/or under layers of the dress may also be gathered with the material of the train 40. FIG. 10 shows the gathered material at the three selected areas 54, 55.

The reclosable pin 10 is then inserted into the gathered material of each area, at which time the conventional dress pin 10, if used, can be removed. Once all the gathered portions have been secured to the reclosable pin 10, the pin 10 is closed, thereby securing the train 40 of the dress 42 in the raised position.

Selecting the areas 54, 55 of the dress to be a distance L from the lower edge of the train 40 means that when the train 40 is in the raised position, the train of the dress 42 is distributed around a wearer such that the lower edge of the train sits just above the ground or is in light contact with the ground.

The ability to raise the train 40 of a dress 42 means that the wearer is able is dance and walk around freely without the need for a train bearer following behind the wearer. Hence the wearer may use the same dress for a first function, such as a wedding ceremony, with the train 40 extending behind the dress 42, and for a second function, such as a wedding reception or dance, with the train 40 raised up on the dress 42.

The lifting of the train can be carried out while the wearer continues to wear the dress.

The pin 10 of the invention can be used with any dress having a train, since it does not require the train to be detachable or to be provided with special attachment means.

The pin 10 of the invention may form a collectible wedding souvenir, since it may incorporate a decoration which remains visible on the mounting portion 29 of the return arm 18 while the pin 10 is in use. The decoration may be personalised, to increase the attraction of the pin 10 as a souvenir.

The shape of the pin is not limited to the shape shown in the drawings, and may adopt any shape in which there is a resilient arcuate base portion, first and second leg portions extending from the base portion, a return arm at the upper end of the first leg extending substantially perpendicular to the first leg, a curved point portion at the upper end of the second leg portion, a point provided at the end of the curved point portion directed towards the first leg portion, and a clasp provided at the free end of the return arm, wherein the pin, when in the closed position, forms a closed loop having a tapered shape such that the closed loop is narrowest adjacent to the base portion.

The pin 10 is typically between 40 and 60 mm in height, preferably about 50 mm. The width of the pin 10 at its lower end adjacent to the arcuate base portion is typically between 10 and 20 mm, preferably about 15 mm. The width of the pin 10 at its upper end, when in the closed position, is typically between 15 and 30 mm, preferably about 22 mm. The gauge of the wire used to manufacture the pin 10 is typically between 1.2 and 1.3 mm, and preferably the wire from which the leg portions and base portion are formed has a diameter of about 1.25 mm. This provides a suitable stiffness for the pin, allowing operation by hand. However other diameters may be used.

The tapered shape, also referred to as a general U-shape with diverging leg portions, acts to collect the gathered material together at the lower end of the pin, improving the appearance of the dress with the raised train.

The pin safe to use, because the pin projects inwardly at the end of the curved portion, so that the gathered material can be pushed over the point into the loop of the pin without risk of injury from the point.

I claim:

1. A method of using a pin to raise a train of a dress having a bodice and a train extending below the bodice, the method comprising the steps of:

providing a pin having a generally U-shaped resilient arcuate base portion, having a first leg portion and a second leg portion, each having an upper and a lower end, wherein the lower end of the first leg portion and the lower end of the second leg portions extend from the base portion, and wherein the first and second leg portions diverge from the base portion to form a truncated V-shape, with a rounded truncated base, further having a curved point portion at the upper end of the second leg portion, wherein the curved point portion terminates with a point which is curved inwardly towards the first leg portion, further having a return arm at the upper end of the first leg extending substantially perpendicular to the first leg portion, further having a clasp provided at a free end of the return arm for engagement with the second leg portion, wherein the clasp comprises a loop extending toward the base portion, the loop having a free end which extends away from the first leg portion to provide an abutment surface for the upper end of the second leg portion directed toward the first leg portion when the pin is in a closed position, and wherein the curved point portion is held inside the clasp by the abutment surface when the pin is closed, and wherein the pin, when in the closed position, forms a closed loop having a tapered shape such that the closed loop is narrowest adjacent to the base portion;

inserting the point of the pin through a first aperture in the bodice of the dress; guiding the pin downwards so that the pin exits through a second aperture in the bodice;

rotating the pin while threading the second leg portion and the base portion through said apertures until the arcuate base portion is at the lowermost position and the first and second leg portions extend upwards from the base portion;

inserting the point of the pin through a portion of the train of the dress such that the pin forms an aperture in the train of the dress; and, engaging the curved point portion and the clasp such that the portion of the train of the dress is held inside the closed loop of the pin in a raised position.

2. A method of raising a train of a dress having a bodice and a train extending below the bodice, the method comprising the steps of:

providing a substantially planar pin, that has a first leg portion and a second leg portion wherein the second leg portion tapers outwards from an arcuate base portion, that further has a return arm and a clasp provided at an upper end of the first leg portion and a point portion engageable with the clasp provided at the upper end of the second leg portion;

inserting the point portion of the pin through a first aperture in the bodice of the dress;

guiding the pin downwards so that the point portion exits through a second aperture in the bodice;

rotating the pin while threading the second leg portion and the base portion through the apertures until the arcuate base portion is at a lowermost position and the first and second leg portions extend upwards from the base portion;

inserting the point portion of the pin through a portion of the train of the dress such that the point portion forms an aperture in the train of the dress; and, engaging the point portion and the clasp to close the pin such that a portion of the train of the dress is held in a raised position inside a closed loop of the pin formed by the first and second leg portions, the arcuate base portion, the return arm, the clasp and the point portion.

3. The method of claim 2, comprising further steps of:

selecting a plurality of areas of the train to be raised;

gathering a portion of the train of the dress at each selected area;

inserting the pin through the train of the dress to hold the gathered portion of the train of the dress in the pin; and, engaging the point portion and the clasp such that the plurality of gathered portions of the train of the dress are held in a raised position by the closed loop of the pin.

4. The method of claim 2, wherein the areas are selected to be a distance from a lower edge of the train which is approximately equal to a distance measured from a waist portion of the dress to a lower edge of the dress at the front of the dress.

5. The method of claim 2, wherein the areas are selected so as to include a first area at the center of the train and a set of two further areas from the center area located either side of the center of the train and approximately equidistant from the first area.

* * * * *